United States Patent [19]

Lin

[11] Patent Number: 4,694,517

[45] Date of Patent: Sep. 22, 1987

[54] UNIVERSAL COUCH

[76] Inventor: Yui-Chen Lin, 237, Syh Te Rd., Wu Fong Hsiang, Taichung Hsien, Taiwan

[21] Appl. No.: 10,668

[22] Filed: Feb. 4, 1987

[51] Int. Cl.[4] ..... A47C 19/16

[52] U.S. Cl. ..... 5/114; 5/111; 297/377

[58] Field of Search ..... 297/377, 440; 5/111, 5/114, 110, 112, 113

[56] References Cited

U.S. PATENT DOCUMENTS

| | | | |
|---|---|---|---|
| 207,060 | 8/1878 | Morambert | 5/114 |
| 324,843 | 8/1885 | Horton | 297/377 X |
| 2,708,276 | 5/1955 | Schloss et al. | 5/111 |
| 3,179,465 | 4/1965 | Roberts | 297/377 X |
| 3,956,781 | 5/1976 | Reemelin | 5/114 |

FOREIGN PATENT DOCUMENTS

| | | | |
|---|---|---|---|
| 516670 | 9/1955 | Canada | 5/111 |

*Primary Examiner*—Francis K. Zugel

*Attorney, Agent, or Firm*—Armstrong, Nikaido, Marmelstein & Kubovcik

[57] ABSTRACT

An improved universal couch characterized by comprising two sets of bed-frame, three sets of base-frame, two positioning rods and supporting rods, two connecting frames and couch-surfaces, wherein three sets of base-frame consist of two separated elements and a cover plate respectively, and the connecting frame is used to connect two couch frames, so that by means of the above elements, the couch frames can be put into the looped sheaths sewed up at the both sides of the couch-surface material, and then they can be assembled respectively with three sets of baseframe to become a completed universal couch, since the positioning rod and the supporting rod, which are pivoted at the frame of the rear couch frame, can be used to raise and support the rear couch surface, and to adjust its angle of elevation in order to have the function of an improved universal couch. Besides, it is very quick and convenient to assemble and disassemble the whose set of couch so that this couch can be used to its best functional limit, and it can also provide the user with the enjoyment of sitting and lying at his leisure time.

3 Claims, 7 Drawing Figures

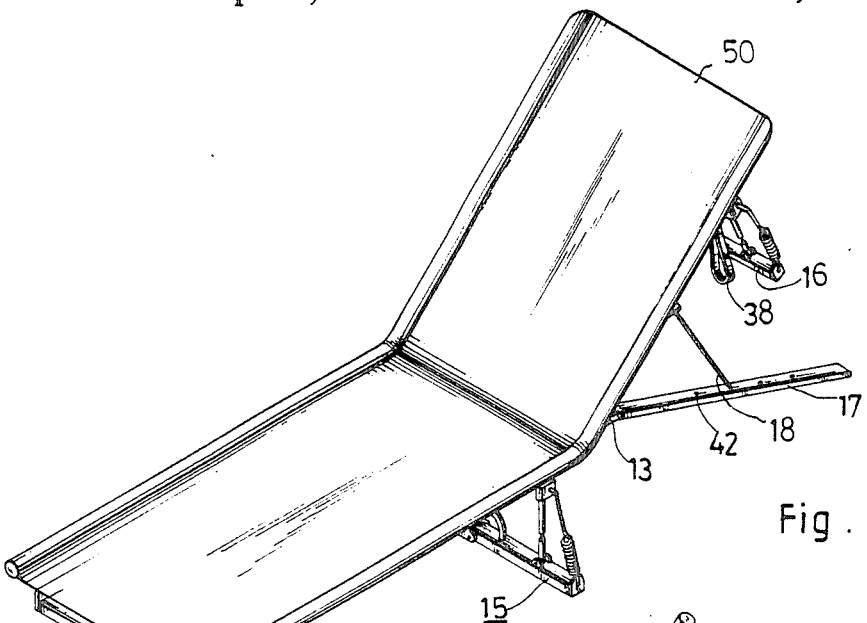
Fig. 1
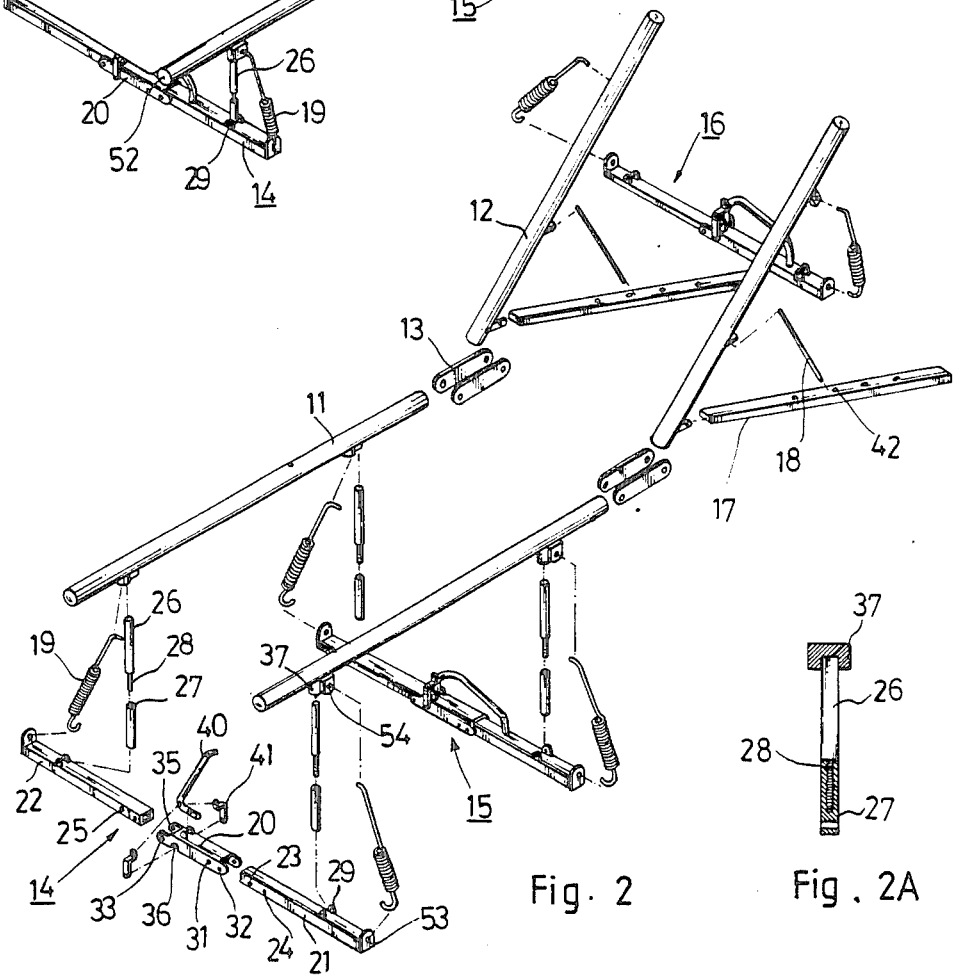
Fig. 2
Fig. 2A

UNIVERSAL COUCH

BACKGROUND AND SUMMARY OF THE INVENTION

Most of the conventional beach chairs are of the lying-chair type. However, after using it for a period. it is found that this type of beach chair has the disadvantage of having large volume after being folded up. thus causing inconvenience in carrying along, besides, it has also the disadvantage of being unable to be placed in an stable condition on the beach ground. Owing to the above mentioned disadvantages, many improved products have been designed, such as "field-use spring bed", etc. Basically, these are only simple type of beddings, easy to be rolled up so that their volume can be reduced to the minimum. This is especially important when groups of people (such as family groups) travel around. However, in practical application, the above mentioned products still have the following defects:

1. In application, the bed surface must be aligned in horizontal level, that is, these products can only be used as lying beds which are not suitable for tourists because what the tourists need is a couch the upper half of which should be able to be elevated for a certain angle, so that the tourists can read or enjoy the nearby scenery. Therefore, the above mentioned products cannot meet the practical requirements for the field use to the best effect.

2. The manufacturer of the above mentioned products claimed that because of having the elastic triangular supporting body constructed by assembling the supporting rods at the two ends of the base frame, together with the elastic elements, their products can overcome the difficulty of using the products on irregular terrains. As a matter of fact, the above mentioned supporting frame and elastic elements is mainly designed for maintaining the bed-surface in a level and smooth condition, and is not designed for overcoming the irregularity of the ground surface. Since the supporting frame itself is also of the rigid-body design, there is no way to give the supporting frame some flexibility to follow the irregular shape of the ground surface. If the supporting rod is designed to have some elasticity, then, it will not be able to sustain the weight of the human body, and will have the possibility of being bent and deformed. Therefore, the above mentioned products also have the disadvantage of being limited in application by the irregularity of the ground surface.

3. Another disadvantage of the above mentioned products is that it is very inconvenient for the users to assemble the elements together. This is because of the fact that during assembly, the elastic elements at the two ends of the base frame must be pulled with considerable force. It is very difficult to do the job, especially for one person.

In view of the above mentioned disadvantages of the conventional couch, the inventor worked hard to study and improve, and succeeded in presenting this invention. The main purpose of this invention is to design a kind of couch suitable to be used indoors and outdoors. In other words, besides the advantage of being easily rolled up and conveniently carried along, this invention due to its two-section construction, can have the advantage of elevating the rear couch surface to a certain degree as the user likes, so that this couch can be used to its best functional limit, and it can also provide the user with the enjoyment of sitting and lying at his leisure time.

Another purpose of this invention is to provide the supporting rods at the two ends of the base frame, with a kind of two-section screw-thread design, so that the height of the base frame can be adjusted according to the condition of the ground surface. The result is that the couch-surface can be kept in a level and smooth condition under any circumstances, and therefore, it is comfortable for the user to sit on or lie down.

Still another purpose of this invention is to provide a new type of design of the three sets of the base frame which can be bent as if they were made of two portions. Besides, when necessary, the two portions can also be put in alignment and fixed automatically. This can be done only by pushing the handle downward so that the above mentioned two portions can be aligned and fixed correctly and the couch surface will be stretched tightly. Thus, it is very easy for the user to assemble the couch body without making much effort.

BRIEF DESCRIPTION OF THE DRAWINGS

FIG. 1 is a complete pictorial sketch of this invention. This sketch shows the completed universal couch suitable for sitting and lying during the leisure time, after the whole frame and couch surface have been assembled together.

FIG. 2 is an exploded view of the whole frame of this invention. This view shows the assembling relationship between the frame elements which comprise the whole frame of the universal couch.

FIG. 2-A is a sectional view of the assembly drawing when the supporting rod and the hollow bushing have been assembled together.

FIG. 3-A is a schematic view of the assembling of the pivoted connection between the connecting frames and the two couch frames of this invention.

DETAILED DESCRIPTION OF THE PREFERRED EMBODIMENT

Figure 3:
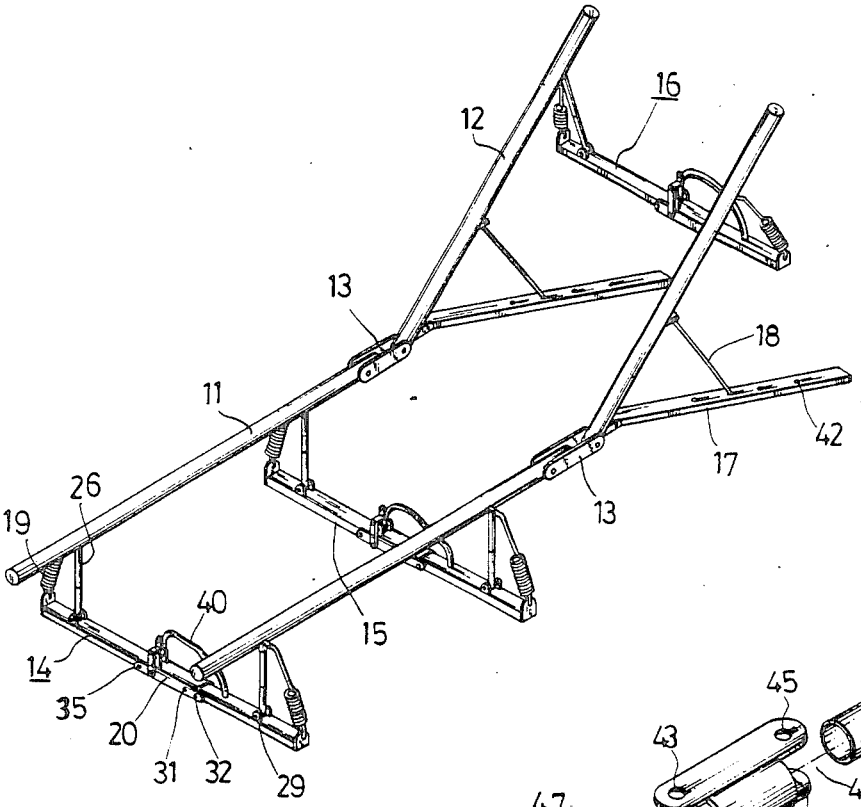
FIG. 3 is an assembly drawing of the whole frame of this invention. It is also the completed couch-frame which is assembled from whole set of frame elements of the couch body.
Figure 3A:
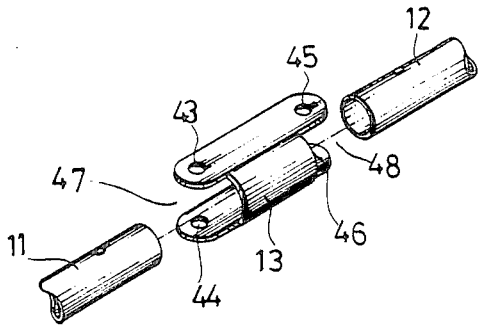

As shown in the drawings two sets of couch frame 11, 12, of about the same length, are connected respectively by connecting frame 13 so that the two sets of couch frame 11, 12 can be aligned in level position, or the couch frame 12 can be raised in an elevated position. Between the couch frame 11,12, a couch surface made of tough material 50 is provided. In order to put the couch surface material 50 on the couch frame, the two sides of the surface material 50 are sewed up to form two looped sheaths 51, 52, into which the above mentioned couch frames 11,12 are put in. Thereafter, the assembling work of the couch surface frame will be completed.

As shown in FIGS. 2 and 3, three sets of base frames 14,15,16 are respectively installed on the front, middle, and rear positions of the couch. On the two ends of every base frame, there are respectively supporting rod 26 and elastic element 19, the method of connection of which is described as follows: the supporting rod 26 is composed of upper and lower parts, and on the upper part of the supporting rod 26 there are male threads 28 and on the surface of inner hole of the lower part, there are female threads 27. Thus, the two parts are jointed together by turning the threaded part, as shown in FIG. 2A. and the lower part is connected with the ear 29 of the base frame 14, while the upper end of the upper part of the supporting rod is inserted into the hollow bushing 37 which protrudes from the underside of the couch frame 11. The lower end of the elastic element 19 is hooked up at the hook joint 53 of the base frame 14, while the upper end of the elastic element 19 is hooked up at another hook joint 54 on the underside of the couch frame 11.

Figure 4:
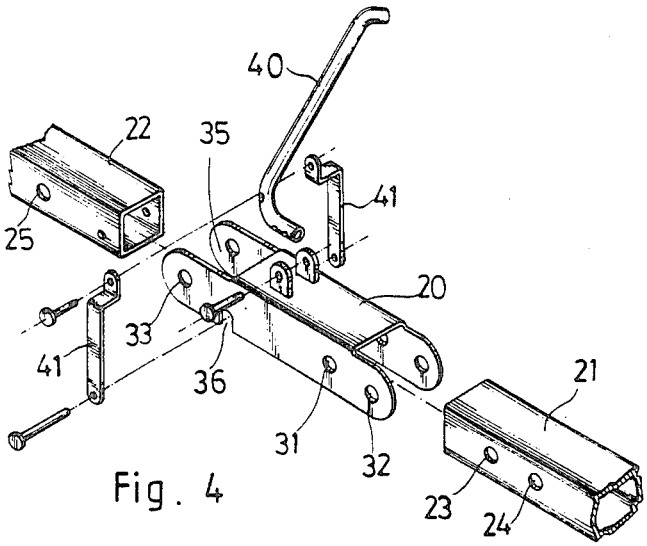
FIG. 4 is an exploded view of the ⊓ type cover-plate for connecting the square-sectioned base elements. This view shows the assembling relationship between the base elements which comprise three sets of the base-frame. The ⊓ type connecting cover plates are also repectively connected with supporting rods. A control handle is provided on the top of the ⊓ type connecting cover plate.

As shown in FIG. 4, three sets of the base frame 14,15,16 are respectively composed of two square-sectioned elements and one ⊓ type cover-plate, wherein the element 21 has through holes 23, 24 and the cover-plate 20 has through holes 31, 32 so that said element 21 can be tightly fastened with said cover-plate 20 by putting bolts through the above mentioned four through holes and bolted together. Another element 22 has through hole 25 and the cover-plate 20 has through hole 33 so that said element 22 can also be bolted together with said cover-plate 20. Besides, since there is indentation 35 on the surface of the said cover-plate 20, the element 22 can be bent and moved up and down. In addition, a handle 40 is pivot-jointed on the cover-plate 20 and the underside of the handle 40 is connected with the element 22 by the connector 41. On the said cover-plate 20, there is a groove 36 whereby the element 22 can be put smoothly into the cover-plate 20.

As shown in the drawings the positioning rod 17 and supporting rod 18 are pivot-jointed on the couch frame 12. On the positioning rod 17, there are several positioning holes 42, and by inserting the lower end of the supporting rod, which is situated above the positioning rod 17, into the positioning holes 42, the rear couch frame can be moved up and down. On the couch frame above the supporting rod 18, there is a sling 38 which can carry and bind the positioning rod 17 and supporting rod 18 together and thus fix them in position, when the couch is contracted and rolled up.

The connecting frame 13 is like the ⊓ type cover-plate, but has a round shape cover over two side plates, and is manufactured integrally by punching. At two ends of this connecting frame 13, there are four holes 43, 44, 45, 46 whereby, the couch frames 11,12 can be respectively connected together. Besides, there are also two indentations 47, 48 at the two ends of the connecting frame 13, so that the couch frames 11,12 can be bent relatively to each other (as shown in FIG. 3).

The operation procedure of the above mentioned universal couch is summarized as follows:

1. Put the couch frames 11, 12, which have been pivot-jointed together by the connecting frame 13, into the two looped sheathes 51, 52 at both sides of the couch surface 50 respectively. This procedure only to be done at the first time of assembling. After first time of using the couch, it is only necessary to roll-up the couch surface after the two couch frames 11,12 have been folded-up one against the another. Then, it is only necessary to put the folded-up couch frames into a special bag for storage or carrying. Next time, when it is going to be used, it is only necessary to stretch out the couch surface.

2. The lower ends of the elastic elements 19 are hooked up at the hook joints 53 of the base frames 14, 15, 16 respectively, while the upper ends of the elastic elements 19 are hooked up at hook joints 54 on the underside of the couch frames 11. After this procedure, the supporting rod 26 is inserted into the mouth of the bushing 37, then the supporting rod is turned so that its male threads 28 can be screwed into the female threads 27 of the lower part, and the position will be fixed.

At this time, the position of the handle 40 on the cover-plate 20 is in the "UP" state. During this "up" state, the element 22 of the base frame can be lifted a little bit so that the supporting rod and elastic element 19 can be easily hooked up to the couch frame 11. After this procedure, the handle 40 should be pressed down, so that the elements of the base frame 21, 22 can be gradually in alignment with each other until the two elements are arranged in a straight line, and the couch surface will be stretched horizontally. Therefore, the assembling work can be completed very simple without making much effort.

Figure 5:
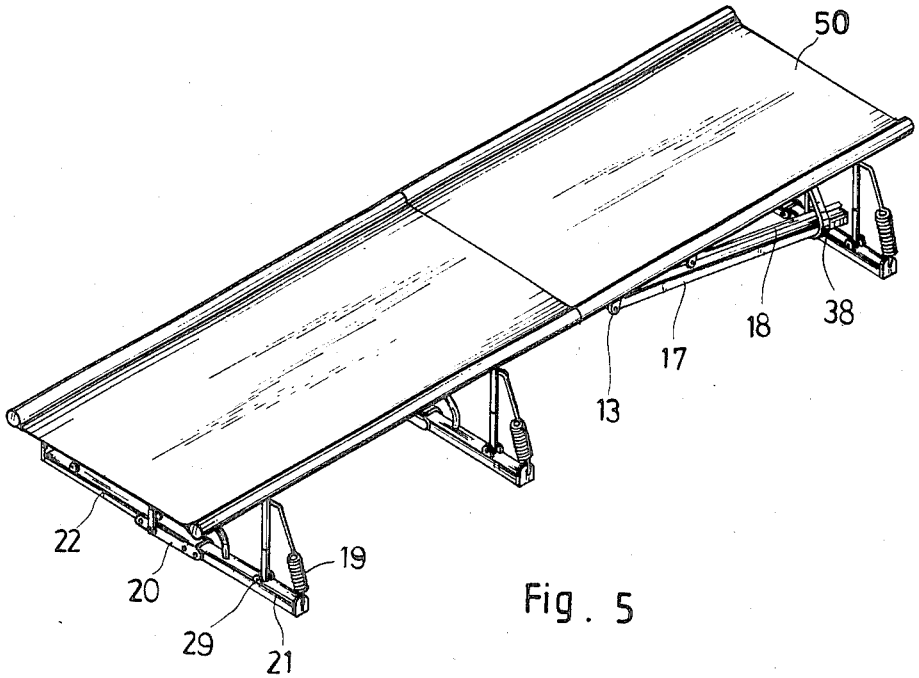
FIG. 5 is a complete pictorial sketch of this invention when two couch surfaces are assembled and aligned in the same horizontal level. In this state, supporting rods and positioning rods have been contracted together.

3. In order to elevate the rear couch surface, it is necessary, at first, to move the positioning rod 17 at the rear of the couch frame 12, so that, by proper selecting the positioning holes 42 on the positioning rod, the best angle of elevation of the rear couch frame can be obtained. If the user likes to arrange the two couch frames in a horizontal straight line for himself to lie down, as shown in FIG. 5, the positioning rod 17 and supporting rod 18 can be folded up and put them together in a sling 38. This is very convenient for the whole couch to be rolled up.

4. After the assembling work is finished, the height of each supporting rod 26 can be adjusted according to the ground shape, or, in order to ensure perfect comfortable condition for the user to sit on or lie down, the couch surface 50 must be kept in perfect horizontal position by adjusting the height of positioning rod 17 and supporting rod 18.

5. When the couch is to be stored up, it is necessary at first to contract the positioning rod 17 and supporting rod to a fixed position, and also to pull the handle 40 upward so as to bend the base element 22 up a little bit. Then, the base frame including elastic element 19 and supporting rod 26 can be put on the couch surface 50. and the couch frames 11, 12 can be folded up from left to right or from right to left. Finally, the whole elements can be rolled up and put into a special bag for storing.

I claim:

1. An improved universal couch, especially one characterized by comprising:

three sets of base frames, of which each set consists of two base elements, cover plates, supporting rods and elastic elements which are movably attached at two ends of the base elements; and the said three sets of base frames can be installed respectively at the front, middle and rear three special positions of the couch surface, in order to assemble and support the couch surface;

two couch frames, of which, each frame is arranged at one of the two sides of the couch surface, and of which each frame consists of two round tubes of the same size, said two tubes being connected together along the same direction, one in front of the another, by a connecting frame and said two tubes being able to be folded up for storing, furthermore, at two ends of the front tube and at underside of one end of the rear tube, a bushing and a fixed ear having been provided so that they can be used to connect supporting rods and elastic elements of the three sets of the base frame, in addition, two pivot-jointed pieces, leaving a proper distance between them, having been provided at the front end of the rear tube;

one couch surface made up from a whole sheet of tough material, each side of which having been provided with a long, looped sheath so that the two couch frames can be inserted into the said two sheaths respectively, furthermore, at the mouth of the sheath, indentation having been provided, in order to expose the mouth of couch frame and the fixed ear, in addition, at two sides of the rear couch surface a sling being sewed on:

one positioning rod and supporting rod, being movably attached to the pivot-jointed pieces of the rear tubes, and on the positioning rod, several positioning holes having been provided, so that by selecting the positioning holes for the supporting rod, the best angle of elevation of the rear couch surface can be obtained;

an improved universal couch being able to be assembled by means of the above elements such that the couch frame can be inserted into the looped sheaths at two sides of the couch surface, which is to be connected with three sets of the base frame in order to be constructed into a whole couch body, and the rear couch surface of which can be elevated the required angle by means of its positioning rod and supporting rod.

2. An improved universal couch according to claim 1 wherein the supporting rod, which is movably attached to the base frame, is manufactured from two parts connected together by means of screw threads, and characterized by the function that the upper section of the said supporting rod can be turned, in order to adjust the length for supporting the couch surface.

3. An improved universal couch according to claim 1 wherein the foot bar of the three sets of the base frame is designed as a two-section construction, and an inverted ⊓ shape cover-plate is riveted on the joint position of the two separated elements of the foot bar, so that one element of the foot bar is fixed with the cover-plate by means of rivet, while the another element is movably attached to the cover-plate, and a handle is provided on the cover-plate, the underside of the handle is connected with the movably-attached element by a connecting piece, and an indentation is provided on the cover-plate so that when the handle is pushed downward, the two separated elements can be pressed to become a smooth joint and arranged in horizontal alignment, in order to complete the assembling work of the couch body; while at the time of disassembling, it is only necessary to pull the handle upward, then the movably-attached element will be lifted a little bit, so that the tension of the couch surface will be relieved and then the three sets of the base frame can be quickly disassembled, in order to complete the rolling-up work of the couch body.

* * * * *